US007104416B2

(12) United States Patent
Gasco et al.

(10) Patent No.: US 7,104,416 B2
(45) Date of Patent: Sep. 12, 2006

(54) SHAPED CONTAINER BOTTOM

(75) Inventors: Mary Carmen Gasco, Baltimore, MD (US); Shane Edwin Meeker, Maineville, OH (US); Ronald Peter DeVlam, Chicago, IL (US); Mark William Rakentine, Gloucester Point, VA (US); Patrick Lee O'Brien, Yorktown, VA (US); Jean-Marc Henri Kirouac, Williamsburg, VA (US); Janet Adele Veith, Williamsburg, VA (US)

(73) Assignee: The Procter Gamble Company, Cincinnati, OH (US)

( * ) Notice: Subject to any disclaimer, the term of this patent is extended or adjusted under 35 U.S.C. 154(b) by 679 days.

(21) Appl. No.: 10/010,818

(22) Filed: Dec. 6, 2001

(65) Prior Publication Data

US 2002/0125255 A1 Sep. 12, 2002

Related U.S. Application Data

(60) Provisional application No. 60/254,187, filed on Dec. 8, 2000, now abandoned.

(51) Int. Cl.
*B65D 1/16* (2006.01)

(52) U.S. Cl. ..... 220/608; 220/623

(58) Field of Classification Search ..... 220/623, 220/608, 606, 605; 426/106, 110, 121; 206/499
See application file for complete search history.

(56) References Cited

U.S. PATENT DOCUMENTS

| | | | | |
|---|---|---|---|---|
| 3,498,798 | A | 3/1970 | Baur et al. | |
| 3,852,485 | A * | 12/1974 | Beall | 426/106 |
| 3,929,953 | A | 12/1975 | Van der Gaag et al. | |
| 3,956,489 | A * | 5/1976 | Beall | 426/106 |
| 4,011,347 | A | 3/1977 | Griffith | |
| 4,164,588 | A | 8/1979 | Johnson | |
| 4,647,509 | A | 3/1987 | Wallace et al. | |
| 4,824,618 | A | 4/1989 | Strum et al. | |
| 4,873,099 | A * | 10/1989 | Ruiz | 426/104 |
| 5,641,524 | A | 6/1997 | Rush et al. | |
| 6,042,856 | A * | 3/2000 | Sagan et al. | 426/87 |
| D457,428 | S * | 5/2002 | Fowler et al. | D9/424 |

FOREIGN PATENT DOCUMENTS

EP 1 151 936 A2 11/2001

* cited by examiner

*Primary Examiner*—Stephen Castellano
(74) *Attorney, Agent, or Firm*—S. Robert Chuey; Carl J. Roof

(57) ABSTRACT

Disclosed is a shaped container bottom for containing a plurality of curved snack pieces where the container bottom comprises a bottom panel. The bottom panel has a concave-shape about a major axis of the container. The concave bottom panel conforms to the shape the snack piece without the snack piece resting upon the bottom panel.

Also disclosed is a shaped container bottom for containing a plurality of curved snack pieces where the container bottom comprises a bottom panel. The bottom panel further comprises a plurality of flat portions and a bottom panel center disposed between the flat portions. The bottom panel center conforms to the shape of the snack pieces.

19 Claims, 4 Drawing Sheets

SHAPED CONTAINER BOTTOM

CROSS REFERENCE TO RELATED APPLICATIONS

This application claims priority to U.S. Provisional Application No. 60/254,187, filed Dec. 8, 2000 now abandoned.

FIELD OF THE INVENTION

The present invention relates to container bottoms suitable for use with shaped snack pieces. The bottoms and containers comprising them are adapted, for example, for packaging a stack of curved, frangible snack pieces such as potato chips or crisps, tortilla chips and the like.

BACKGROUND OF THE INVENTION

Packaged snack pieces are a very popular food item. These snack pieces include but are not limited to potato chips or crisps, tortilla chips, etc. Commonly, snacks such as potato chips are packaged at random in a bag. This leads to low bulk density in the bag and therefore the package takes up valuable space during storage, shipping and displaying of the package and product. The snacks are also easily broken or crushed during packaging, shipping and other handling.

Some of the snack pieces available are substantially the same size and shape and are generally non-planar in shape, i.e., they have a substantially concave shape. This concave shape may be in the form of a single curvature or a compound curvature such as the Pringles® potato crisps sold by The Procter & Gamble Company of Cincinnati, Ohio.

Due to the snack pieces similar shape and size, they are typically stacked together and therefore allow high bulk density in a container. This leads to both decreased packaging per net weight of product and improvement of the product because the stacking creates less of a risk of chips being broken or sliding up the side of the container. These snack pieces are generally packaged into a foil fiber canister having a flat metal bottom panel. This flat bottom panel does not conform to the shape of the chip and thus does not identify to the consumer the type of product contained within the package. It is desirable to have the package itself identify the type of product contained within the package because it will reduce the need for labeling. One such way would be to shape the container bottom to conform to the shape of the curved snack pieces within the container. However, if the shape of the container bottom too closely conforms to the chip's shape such that the chip's surface rests upon the surface of the container bottom's end panel, the chips will experience increased breakage due to forces during handling and shipping of the containers. In addition, the snack pieces do not self-center or self-nest properly in the bottom of the canister, thus causing "slip" or "denested" chips.

It is desired to have a minimal clearance between the chip and the container bottom end panel such that the chip will not rest upon the bottom's surface.

Accordingly, there is a need for an inexpensive plastic container for packaging frangible snack pieces such as potato chips or crisps, which reflects the shape of the chip for purposes of identifying the product to the user and yet reduces article breakage resulting from typical packaging, shipping and handling.

SUMMARY OF THE INVENTION

In one aspect, the invention relates to a shaped container bottom for containing a plurality of curved snack pieces, each snack piece having a peripheral edge and a lower surface, within a container, the container bottom comprising a bottom panel having a concave-curvature about a first axis of the bottom panel, wherein the concave-curvature of the bottom panel substantially conforms to the curvature of the snack pieces and at least a portion of the peripheral edge of a lowest snack piece of the plurality of snack pieces rests upon the bottom panel.

In another aspect, the invention relates to a shaped container bottom for containing a plurality of curved snack pieces, each snack piece having a peripheral edge and a lower surface, within a container, the container bottom comprising a bottom panel comprising at least two base portions and a bottom panel center disposed between the base portions, the bottom panel center having a concave curvature about a first axis of the container, wherein the concave-curvature of the bottom panel substantially conforms to the curvature of the snack pieces and a peripheral edge of a lowest snack piece of the plurality rests upon the flat portions.

In yet another aspect, the invention relates to a process for filling a container with curved snack pieces, the process comprising providing a container having a shaped bottom that conforms to the shape of the snack pieces and introducing the snack pieces into the container such that the pieces self align because of the shape of the container bottom.

BRIEF DESCRIPTION OF THE DRAWINGS

While the specification concludes with claims which particularly point out and distinctly claim the present invention, it is believed that the present invention will be better understood from the following description of specific embodiments, taken in conjunction with the accompanying drawings, in which like reference numerals identify like elements, and wherein:

DETAILED DESCRIPTION

Figure 1:
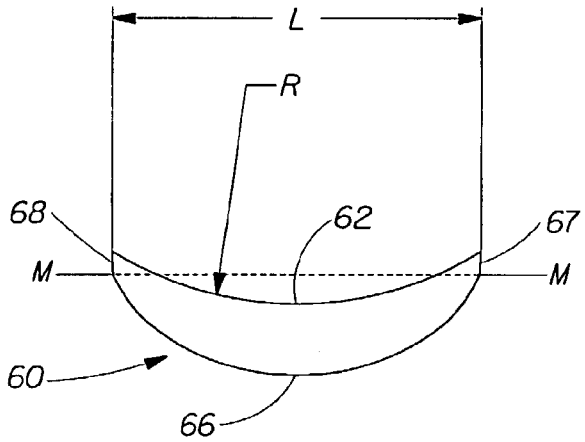
FIG. 1 is a side elevation view of one embodiment of a substantially concave-shaped snack piece shown for illustrative purposes.

The present invention provides a shaped container bottom which can be used in combination with a container body to package similarly shaped snack pieces, for example, Pringles® potato crisps and the like. Such a container bottom needs to be shaped enough to reflect the product's shape so as to identify to the consumer what product is contained within the package without the necessity of labeling. This can be especially helpful in smaller sized packages, such as single serving snack packages, where labeling space is limited.

The container bottom of the present invention can be any cross sectional shape without changing the scope of the present invention. Also, the container bottom's size and shape is determined based upon the size and shape of the snack piece that will be contained within the container. The container can hold any type snack piece, such as potato chips, potato crisps, tortilla chips and the like. Also, these snack pieces can be any size and shape snack piece. The shape of the chip includes non-planar shapes such as a chip shape having at least one concave curvature. The chip can also have a plurality of non-planar shapes, forming compound curved shapes.

FIGS. 1 through 4 show some examples of the type of shaped snack pieces 60 that can be contained within the container and the container bottom of the present invention. Generally, the chips have a major axis M, a minor axis N, an upper surface 62, a lower surface 64 and a peripheral edge 66.

Figure 2:
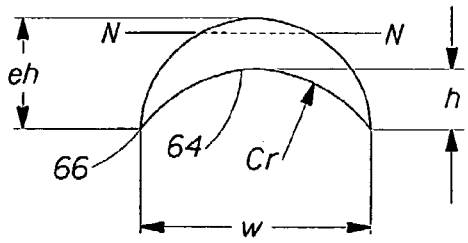
FIG. 2 is a front elevation view of the snack piece shown in FIG. 1.

FIGS. 1 and 2 show one example of a concave-shaped chip that might be contained in the container bottom. In this embodiment, chip 60 has a compound curvature. The terms "compound curve" and "compound curvature", as used herein, each mean the upper and lower surfaces (62 and 64) of the chip are similarly curved in each of two orthogonal planes. For example, chip 60 has a shape that is curved about major axis M creating a substantially downwardly concave lower surface and is also curved about minor axis N creating a substantially upwardly concave upper surface. In one example of this particular chip, the chip has a length (l) (see FIG. 1) from about 45 mm to about 85 mm, typically from about 55 mm to about 75 mm. The chip has a width (w) (see FIG. 2) from about 25 mm to about 65 mm, typically 40 mm to about 50 mm. Further, the chip has a saddle center radius (cr) (see FIG. 2) from about 5 mm to about 60 mm, typically from about 20 mm to about 30 mm. In another embodiment, the saddle center radius (cr) is about 28 mm. Also, the chip has a saddle center height (h) (see FIG. 4) that is greater than 0 mm and up to about 30 mm, typically from about 2 mm to about 20 mm, and a saddle length radius (r) (see FIG. 1) that is from 0 mm to about 100 mm, typically about 60 mm to about 70 mm. In another embodiment, the saddle center height (h) is from about 7 mm to about 15 mm and the saddle length radius (r) is about 65 mm.

Figure 3:
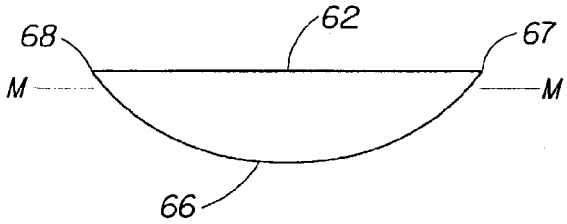
FIG. 3 is a side elevation view of an alternate embodiment of a substantially concave snack piece snack piece shown for illustrative purposes.
Figure 4:
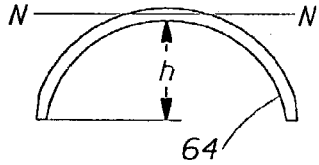
FIG. 4 is a front elevation view of the snack piece shown in FIG. 3.

FIGS. 3 and 4 show another example of a concave-shaped chip that might be contained in the container bottom. In this embodiment the chip has a shape that is curved about the major axis M, wherein the chip is curved in one orthogonal plane and creates a substantially concave curved lower surface. In this example, the chip's dimensions can be the same as set forth above, except for the bottom panel length radius (r) is equal to zero because this chip has no curvature about the minor axis N. Since there is no curvature about minor axis N, chip upper surface 62 does not curve in an upwardly concave manner.

It will be recognized that the concave-shape of the chip does not have to be a continuous or smooth curve. The chips set forth above are presented for illustrative purposes only and are not meant to limit the present invention.

Referring to FIGS. 5 through 10 depict various aspects of the container bottom and containers of the present invention. Although the figures describe preferred embodiments, the skilled artisan will recognize that various other shapes are possible, so long as the interaction between the snack pieces and the container are in accordance with the present teachings.

Figure 5:
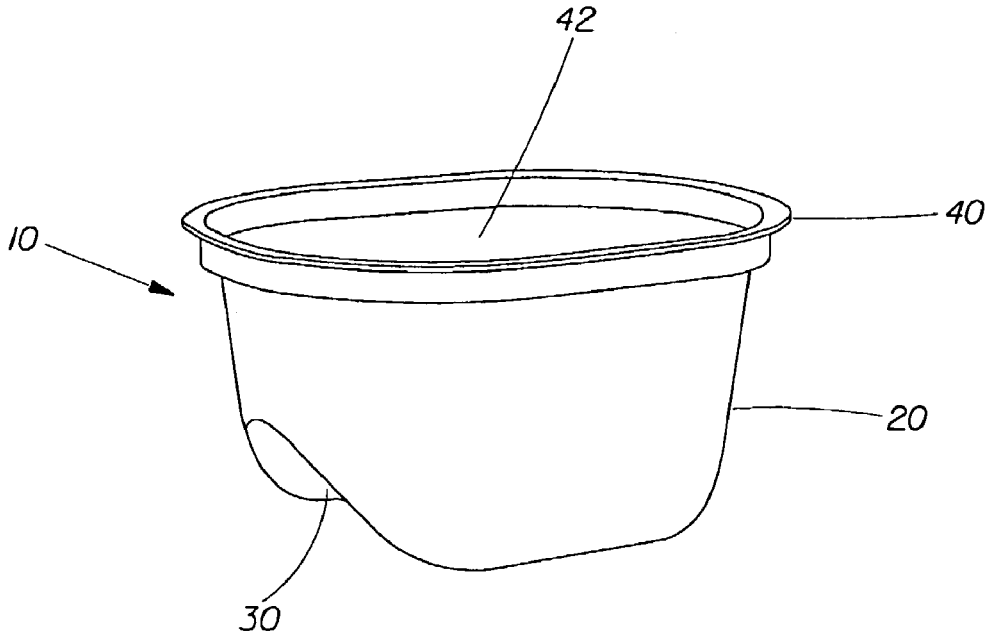
FIG. 5 is a perspective view of a container having a shaped container bottom, according to the invention.
Figure 6:
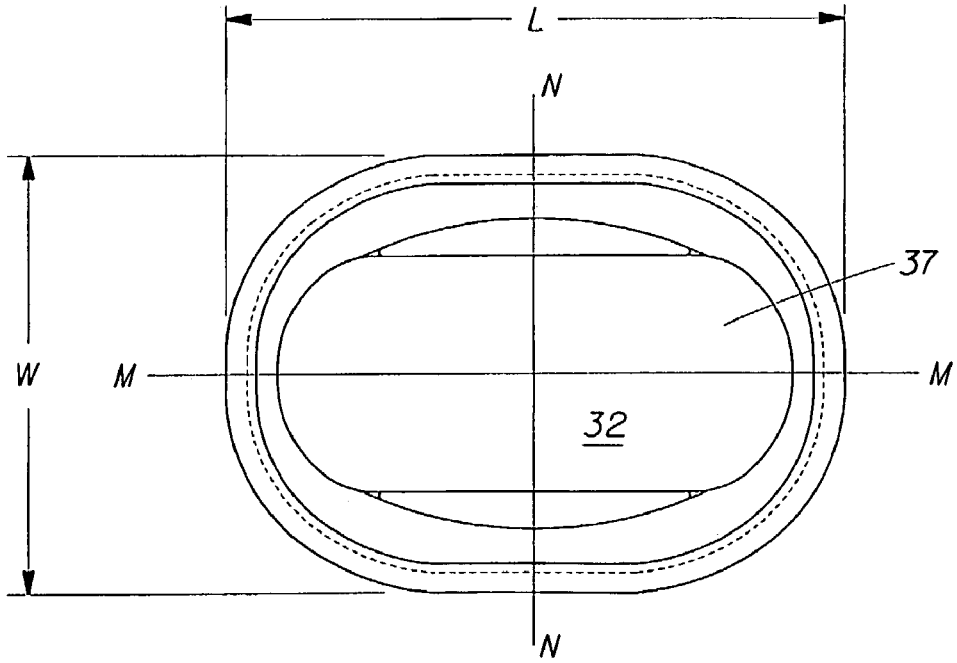
FIG. 6 is a top planar view of the container of FIG. 5.
Figure 7:
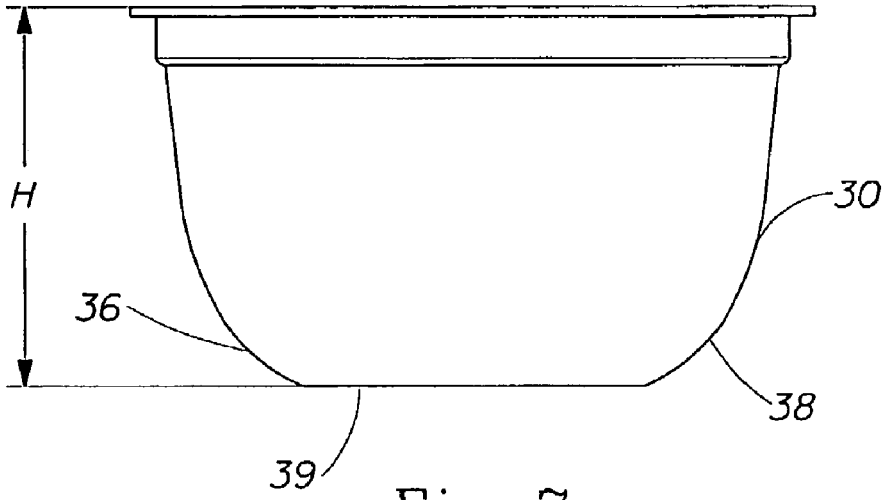
FIG. 7 is a side elevation view of the container of FIG. 5.
Figure 8:
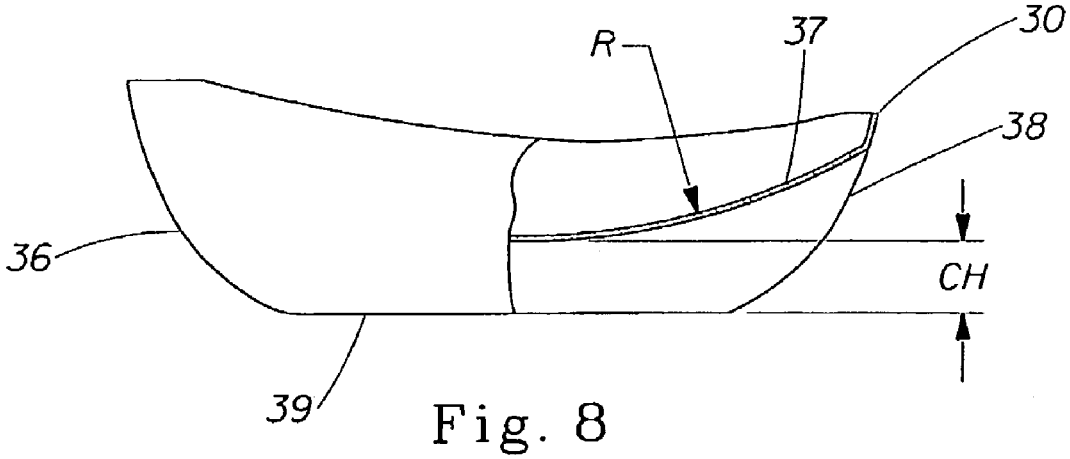
FIG. 8 is a partial cross-sectional view of the container bottom of FIG. 5.
Figure 9:
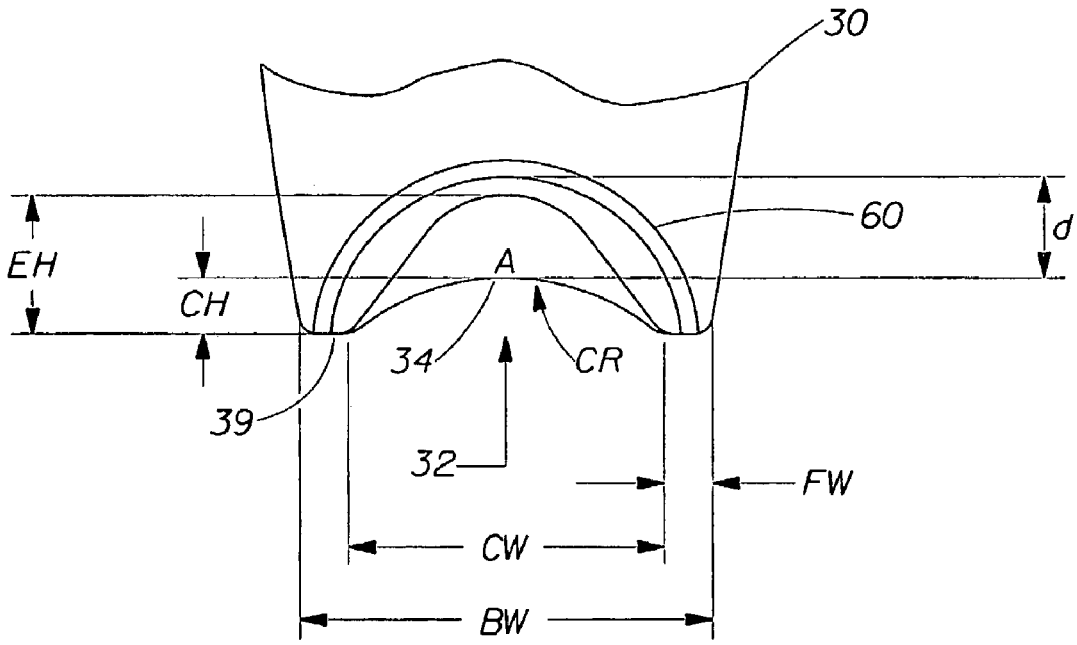
FIG. 9 is a front elevation view of the container bottom in FIG. 5 containing a snack piece.

In FIGS. 5 through 10, one particular embodiment of a container 10, which includes container bottom 30 according to the present invention, is shown. As shown in FIG. 5, container 10 may also include a container body 20 and a container lip 40. FIG. 6 illustrates that container bottom 30 has a major axis M, a minor axis N and a shaped bottom panel shown generally as 32. Referring to FIGS. 7, 8 and 9, bottom panel 32 includes a bottom panel center 34 (see FIGS. 8 and 9), a bottom panel first end 36 (see FIGS. 7 and 8), a bottom panel second end 38 (see FIGS. 7 and 8) and base portion(s) 39. Bottom panel 32 can have a variety of shapes, including but not limited to singular or multiple curved shapes that are continuous or discontinuous without changing the scope of this invention. In this particular embodiment, bottom panel 32 forms a compound curve, wherein bottom panel 32 has a first curve about the major axis M, forming a downwardly concave curve, and a second curve about the minor axis N, forming an upwardly concave curve. In another embodiment, bottom panel 32 forms a first curve about the major axis M, but does not form a second curve about minor axis N. Bottom panel 32 has an interior surface 37 as shown in FIGS. 6 and 8.

The base portions 39 are configured to provide stability to container 10 during conveying, packing, shipping, and retailing. Additionally, base portions 39 provide the support for chip peripheral edge 66 to rest upon. In one embodiment, as shown in FIGS. 7, 8 and 9, base portions 39 can be in the form of substantially flat "feet" that run a sufficient length of container bottom 30 along both sides of container bottom 30 to provide the desired stability. These flat portions can be of any length and width so long as the flat portions are sized to permit the chip peripheral edge 66 of the lowermost snack piece to make contact with base portions 39 and to provide the desired stability. Also, the minimum width (FW; see FIG. 9) is dictated in part by the ability of the plastic to flow into the sharp corners of substantially flat base portions 39 during the forming process, which is dependent upon the material flow characteristics. Substantially flat base portions 39 can be any desired dimension but generally have a width (FW) from 0 mm to about 40 mm, typically from about 5 mm to about 15 mm. Preferably, substantially flat base portions 39 have a width (FW) of greater than 0 mm. In another embodiment, substantially flat base portions 39 can have a width of about 10 mm. In this embodiment, bottom panel center 34 is disposed between these two substantially flat base portions 39.

The curve of bottom panel center 34 must conform to the snack piece's shape but not to the extent such that container 10 becomes unstable. Referring to FIGS. 8 and 9, the conformity of container bottom 30 to chip's 60 shape is controlled by the manipulation of both a bottom panel center height (CH) and a bottom panel center radius (CR). As shown, center height (CH) is the perpendicular distance from the highest point along the curve of bottom panel center 34 (Apex (A)) and the horizontal plane created by the bottom of base portions 39. Center height (CH) cannot be so high that it prevents chip 60 from resting its peripheral edge 66 on base portions 39. In other words, center height (CH) cannot be greater than chip center height (h) because chip peripheral edge 66 will not be able to reach base portions 39. As shown in FIG. 9, a distance (d) is measured between chip lower surface 64 and Apex (A) of panel center 34. In the case of center height (CH) being greater than saddle height (h), distance (d) is less than 0 mm. This will increase the breakage of the chips and decrease the stability of the stack of chips within the container. The stability of the chips within container 10 will decrease because, rather than the chip peripheral edge 66 resting upon base portions 39, chips 60 are teetering upon bottom panel center Apex (A). Further, this increases the outage, i.e., void space between container 10 and chips 60, within container 10.

When center height (CH) is equal to chip saddle height (h), the container bottom will conform to chip's 60 shape such that chip lower surface 64 could rest upon panel center interior surface 37 dependent upon a radius of curvature of panel center (CR) and how it conforms to the chip's saddle radius (cr). In this case, distance (d) is equal to 0 mm. In this particular embodiment, container bottom 30 reflects the shape of chip 60 and is stable due to the base portions 39. However, if the center radius (CR) conforms to chip saddle radius (cr) to such an extent that chip lower surface 64 does rest upon panel center interior surface 37, then the chips will experience breakage when exposed to loads during shipping and handling.

In an even more particular embodiment, center height (CH) is less than saddle height (h). When center height (CH) is less than saddle height (h), it provides a distance (d) between chip lower surface 64 and interior surface 37 of container panel center 34. Due to this, chip 60 does not rest upon Apex (A), but instead chip peripheral edge 66 rests upon base portions 39. Again, depending upon the radius of curvature of panel center's 34 (CR) conformity to the shape, i.e., the saddle radius (cr), of the chip, chip lower surface 64 may rest substantially upon the entire center interior surface 37 or maintain at least the distance (d) along the entire shape.

Still referring to FIG. 9, in one aspect, distance (d) is from about 0.5 mm to about 30 mm, typically from about 0.5 mm to about 9 mm. In another aspect, distance (d) is from about 0.5 mm to about 6 mm. In this particular aspect, the bottom panel center height (CH) may range from 0 mm to about 40 mm, more typically from about 2 mm to about 15 mm. In another aspect, center height (CH) is from about 6 mm to about 9 mm. However, the lower the bottom panel center height (CH), the less the bottom panel center will match the curvature of the chip and thus the less the chips experience breakage. However, the lower the panel center height (CH), the more void space that is left between chip lower surface 64 of the lowermost chip and bottom panel center 32. It is desirable to limit this void space to increase package efficiency, i.e., bulk density, and to lower rancidity due to lower headspace or outage within container 10.

Also, by controlling the bottom panel center's radius (CR), the center height (CH) can be modified. Center radius (CR) is at least greater than 0 mm. In one embodiment, center radius (CR) up to about 60 mm, typically from about 15 mm to about 35 mm. The dimensions for both center height (CH) and center radius (CR) provided above are for this particular embodiment and are not intended to limit the scope of this invention. Both are dependent upon the size and shape of the chip to be contained within container 10.

Also, due to the conformity of the container bottom 30 to the chip's shape, the container bottom of the present invention may provide an increased bulk density. Additionally, one particular embodiment of the container bottom causes the snack pieces to self-nest and center within the bottom when loaded into the container. The self-nesting is due to the conformity of container bottom 30 to the shape of chip 60. When chip 60 is dropped into container 10, gravity pulls downward on chip 60 and thus drives the chip to its lowest energy state, which is when the chip shape and the container bottom shape align. Additionally, the shaped bottom panel 32 acts as a guide to center and align the chip with container bottom 30.

As set forth above, the container bottom of the present invention conforms to the shape of the chip contained within the container such that bottom 30 reflects the chip's shape. "Conform", as used herein, is defined as wherein the container's structure is formed to closely follow the shape of the chip. An example of the container bottom conforming in three dimensions to the chip's shape is wherein the container panel center is provided with a downwardly concave curve that matches the downwardly concave curve of the chip.

To get additional conformity, the container and the container bottom may have cross sections that conform to the cross section of the chip such that there is minimal void space between the chip peripheral edge 66 and the container's side walls. Examples of the container cross section "conforming" to the cross section of the snack pieces include but are not limited to wherein the snack pieces having an elliptical or oval shaped cross section are contained within a container having an elliptical or oval shaped cross section; the snack pieces having a "substantially triangular shaped" cross section are contained within a container having a "substantially triangular shaped" cross section; the snack pieces having a "substantially diamond shaped" cross section or two "substantially triangular shaped" snack pieces side-by-side are contained within a container having a "substantially diamond shaped" cross section; etc. Examples of the container's cross section not "substantially conforming" to the snack pieces' cross sectional shape include but are not limited to elliptical or oval shaped snack pieces contained within the container having a round shaped cross section; "substantially triangular shaped" snack pieces contained within the container having a round shaped cross section, etc.

Referring to FIG. 9, bottom panel first end 36 and second end 38 also have an end height (EH). End height (EH) is determined by the degree of curvature about the minor axis N. As described above, in one embodiment, a curvature about the minor axis N, which is defined by a bottom panel length radius (R), forms a second concave shape. In the case of a single curved container bottom 30 that would be used to contain a single-curved chip as shown in FIGS. 3 and 4, length radius (R) (see FIG. 8) would be 0 mm and end height (EH) would equal the bottom panel center height (CH), thus forming no curve about the minor axis N. However, in this particular embodiment, bottom 30 has a compound curved shape bottom panel 32, which has a length radius (R) of greater than 0 mm and an end height (EH) of greater than 0 mm. In either of these particular curved bottoms, length radius (R) may range from 0 mm to about 90 mm, typically from about 60 mm to about 75 mm. End height (EH) may range from 0 to about 40 mm, typically from about 2 mm to about 25 mm. Of course, both of these dimensions are dependent on the size and shape of the chip to be contained within container 10.

Container 10, including container bottom 30 and container lip 40, can be formed via several forming methods including, but not limited to, thermoforming, blow molding or injection molding, typically thermoforming. To permit the forming of these complex shapes, container bottom 30 and also container 10 and container lip 40, are most readily formed using a thermoplastic material. Suitable thermoplastic materials include, but are not limited to, polyolefins, such as polyethylene (PE), polypropylene (PP), polystyrene, and the like. The wall thickness is dependent upon the container's depth. Thus, as the container's depth changes so will the thickness of the wall. In one particular embodiment, the container depth is from about 40 mm to about 70 mm. Container 10 will typically have an average wall thickness of from about 0.12 mm to about 0.75 mm, typically from about 0.25 mm to about 0.65 mm, more typically from about 0.35 mm to about 0.50 mm.

Container 10 can be formed from a monolayer plastic such as set forth above. However, such containers have a relatively high gas permeability, have a relatively high water permeability or lack structural rigidity. Hence, they are sufficient for product storage for very short durations but are generally insufficient in that contents cannot be preserved with safety for long durations without deterioration or degradation. For example, polyolefins most broadly used for these plastic containers, such as polypropylene (PP) or high density polyethylene (HDPE), are excellent in moisture barrier properties and sanitary characteristics, but they exhibit high oxygen permeability. Hence, they are generally not suitable for uses where contents such as foods, especially with high fat content, need to be preserved and stored for a long time due to rancidity. Resins having polar groups, such as saponified ethylene-vinyl acetate copolymers, polyvinylidene chloride resins and polyamides, are excellent over polyolefin resins as they exhibit high oxygen impermeability, but these oxygen-impermeable resins are very poor in moisture barrier properties and are inferior in such properties as impact resistance and toughness. Hence, resins having polar groups alone are generally not suitable for packaging dry, frangible snack pieces.

However to achieve both longer shelf life, i.e., greater than six months, of the package and package rigidity, multilayer materials may be employed, an example of which comprises both a polyolefin layer and an ethylene-vinyl alcohol (EVOH), polyvinyl alcohol (PVOH), or nylon layer. These multiple layers can be melt-extruded together with varied thickness to give container 10 having an Oxygen Transmission Rate at 1 ATM no greater than about 15 $ccO_2$ per day per ATM, preferably no greater than about 0.2 $ccO_2$ per day per ATM, most preferably no greater than about 0.005 $ccO_2$ per day per ATM. However, single or multilayer plastic materials may be employed without changing the scope of this invention.

One particular embodiment of the multiple-layer plastic structure of bottom 30 and container 10 is as follows: a virgin polyolefin layer, a tie layer, EVOH, tie resin, and another virgin polyolefin layer. Typically, container 10 will also have one or more layers of regrind material in-between the tie-layer and the virgin polyolefin. The thickness of the EVOH layer is dependent upon the grade of EVOH used and the draw ratio of the container during the thermoforming process. This is commonly known in the art. For example, in one particular embodiment, the thickness of the EVOH layer would be no less than about 0.0025 mm thick and no greater than about 0.075 mm.

A non-limiting example of a multilayer plastic structure comprises an outside layer of virgin PP of a nominal thickness of about 0.2 mm. The adjacent layer is a layer of scrap or "regrind" material that consists of the other layers of the structure. This layer may include additional virgin PP. (Thermoformed structures containing one or more layers of regrind material are well known in the art. See, for example, U.S. Pat. No. 4,647,509 to Wallace et al. and U.S. Pat. No. 4,824,618 to Strum et al., both of which are incorporated herein by reference.) In one embodiment, the regrind layer is about 0.2 mm in thickness. The middle layer is a layer of EVOH having a thickness of about 0.05 mm. On the inner side of this middle layer is a layer derived from combing regrind material and virgin PP; this layer has a thickness of about 0.2 mm. Bonding the middle EVOH layer to both regrind-containing layers are tie (i.e., adhesive) layers of about 0.02 mm each. The inner most layer is a virgin PP layer of a thickness of about 0.2 mm.

One method of making the plastic package described above is thermoforming. Thermoforming utilizes an apparatus comprising a mold having an open molding cavity, a clamping device for clamping a sheet of thermoplastic material around the opening of the molding cavity, a plug mounted for penetration into the molding cavity to draw material of the sheet into the cavity, and means for generating a fluid pressure differential across the walls of the drawn sheet to press it against the walls of the molding cavity. Thermoforming is shown and described in, e.g., U.S. Pat. No. 3,929,953 to van der Gaag et al. and U.S. Pat. No. 5,641,524 to Rush, and which are incorporated herein by reference. The preferred method of thermoforming is Plug-assist Thermoforming and is known for molding hollow articles by the so-called "plug-assist" vacuum thermoforming process. The "plug-assist" vacuum thermoforming process is where the descending plug draws out a thermoplastic sheet, heated to a thermoforming temperature, into the molding cavity, whereupon the thermoplastic sheet is finally shaped in the desired form against the walls of the molding cavity by vacuum applied through the walls of the molding cavity. Use of such an apparatus is also known for other plug-assist molding methods, in which the sheet is molded in the solid phase below the thermoforming temperature or in which the fluid pressure differential is not created by the application of a vacuum but by the supply of a pressurized fluid, often compressed air.

Figure 10:
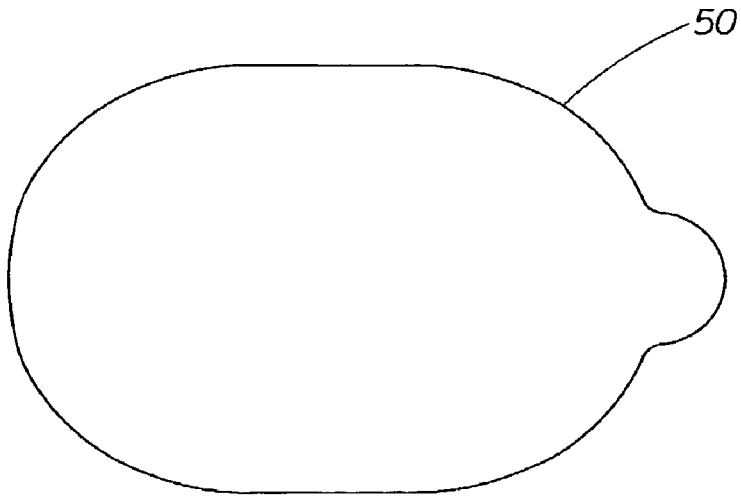
FIG. 10 is a top planar view of a removable lid.

Referring back to FIG. 5, container body 20 includes an open end 42 disposed at an upper end of container 10. Surrounding open end 42 is a continuous lip 40. A removable lid 50 is sealed to continuous lip 40. Continuous lip 40 can be any width so long as it is wide enough to allow the desired seal between removable lid 50 and lip 40. Referring to FIG. 10, removable lid 50 is typically easily peelable with an average removal force ranging from about 0.5 lb. to about 8.0 lb. Removable lid 50 is commonly known in the art. In one embodiment, the combination of membrane lid 50 and lip structure 40 as described herein provices an even pressure distribution along the perimeter of lip 40 upon application of lid 50. This even pressure distribution is important in obtaining and maintaining a hermetic seal that creates a barrier against oxygen and moisture. To increase product stability and shelf life, container 10 may also be flushed with an inert gas or a mixture of inert gases, typically $N_2$, prior to applying removable lid 50 to displace oxygen from container 10 in order to maintain the freshness of container 10 contents. Shelf life for the snack pieces ranges from a few weeks to well over a year depending on package barrier and seal characteristics and storage and distribution conditions. This lid preferably will be a foil seal and can be purchased from any peelable lid manufacturer. One such lid 50 is available from Spiralkote, a subsidiary of Fleming Packaging Corporation.

The specific embodiments and examples set forth above are provided for illustrative purposes only and are not intended to limit the scope of the following claims. Additional embodiments of the invention and advantages provided thereby will be apparent to one of ordinary skill in the art and are within the scope of the claims.

What is claimed is:

1. A shaped container bottom integral to a container for containing a plurality of curved snack pieces, each snack piece having a center radius, a center height, a saddle height, a peripheral edge and a lower surface, within a container, the container bottom comprising a bottom panel having a center radius, a center height, and a concave-curvature about a first axis of the bottom panel, wherein the concave-curvature of the bottom panel substantially conforms to the curvature of the snack pieces and at least a portion of the peripheral edge of a lowest snack piece of the plurality of snack pieces rests upon the bottom panel.

2. The container bottom according to claim 1, wherein the concave-curvature is downwardly curved about the first axis.

3. The container bottom according to claim 2, wherein the first axis is a major axis of the bottom panel.

4. The container bottom according to claim 2, wherein the curvature of the bottom panel conforms to the curvature of the plurality of snack pieces whereby the peripheral edge of the lowest snack piece substantially rests upon the bottom panel.

5. The container bottom according to claim 1, wherein the saddle height of the snack piece is from about 0.5 mm to about 30 mm greater than the center height of the bottom panel.

6. The container bottom according to claim 5, wherein the center height of the bottom panel is from about 2 mm to about 40 mm.

7. The container bottom according to claim 5, wherein the center radius of the bottom panel is not more than about 60 mm.

8. The container bottom according to claim 7, wherein the center radius of the bottom panel is from about 15 mm to about 35 mm.

9. The container bottom according to claim 1, wherein the bottom panel has a second upwardly concave-curvature about a second axis of the bottom panel.

10. A shaped container bottom for containing a plurality of curved snack pieces, each snack piece having a saddle height, a peripheral edge and a lower surface, within a container, the container bottom comprising a bottom panel comprising at least two base portions and a bottom panel center disposed between the base portions, the bottom panel center having a center height and a concave curvature about a first axis of the container, wherein the concave-curvature of the bottom panel substantially conforms to the of the snack pieces and a peripheral edge of a lowest snack piece of the plurality rests upon the base portions.

11. The container bottom according to claim 10, wherein the concave-curvature is downwardly curved about the first axis.

12. The container bottom according to claim 10, wherein the bottom panel has a upwardly concave-curvature about a second axis of the bottom panel.

13. The container bottom according to claim 12, wherein the first axis is a major axis of the bottom panel.

14. The container bottom according to claim 10, wherein the bottom comprises two base portions each base being substantially flat and having a width greater than 0 mm.

15. The container bottom according to claim 10, wherein the curvature of the bottom panel center conforms to the curvature of the plurality of snack pieces whereby the peripheral edge of the lowest snack piece substantially rests upon the bottom panel center.

16. The container bottom according to claim 10, wherein the container bottom is thermoformed.

17. The container bottom according to claim 10, wherein the saddle height of the snack piece is from about 0.5 mm to about 30 mm greater than the center height of the bottom panel.

18. A container comprising the container bottom of claim 1.

19. A container comprising the container bottom of claim 10.

* * * * *